US006558174B1

(12) United States Patent
Hou

(10) Patent No.: US 6,558,174 B1
(45) Date of Patent: May 6, 2003

(54) PICK-AND-PLACE DEVICE OF CPU SOCKET

(75) Inventor: Sung-Pei Hou, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/041,096

(22) Filed: Dec. 28, 2001

(51) Int. Cl.[7] ..... H01R 13/44
(52) U.S. Cl. ..... 439/135; 41/342
(58) Field of Search ..... 439/342, 135, 439/131, 476, 940, 41; 29/740, 741

(56) References Cited

U.S. PATENT DOCUMENTS 4,645,278 A * 2/1987 Yevak et al. ..... 339/17
5,055,971 A * 10/1991 Fukuda et al. ..... 361/400
5,383,797 A * 1/1995 Seong et al. ..... 439/476
5,899,760 A * 5/1999 Ho et al. ..... 439/135
6,135,795 A * 10/2000 Ho et al. ..... 439/135
6,174,171 B1 * 1/2001 Fu ..... 439/41

* cited by examiner

*Primary Examiner*—Alexander Gilman
(74) *Attorney, Agent, or Firm*—Wei Te Chung

(57) ABSTRACT

A pick-and-place device includes a substantially rigid board having a bottom face positionable and releasably attachable to a surface of a socket connector in which a plurality of passages are defined. The rigid board covers a first group of the passages with a second group of the passages not covered by the board. Openings are defined in the board to expose some of the passages of the first group for enhancing heat transfer. A solid portion of the rigid board forms a top face of the board for vacuum handling purposes. A flexibe, thin film has a first surface on which adhesive is coated for attaching the film to socket connector and covering both the passages of the second group and the exposed passages of the first group for shielding the passages against contaminants. The film partially overlaps and is adhesively attached to the top face of the board and has an opposite second surface exposed for vacuum handling of the socket connector. The film is thin and thus has no significantly adverse effect on heat transfer.

3 Claims, 2 Drawing Sheets

PICK-AND-PLACE DEVICE OF CPU SOCKET

BACKGROUND OF THE INVENTION

1. Field of the Invention

The present invention generally relates to a socket connector for mounting a Central Processing Unit (CPU) module to a circuit board, and more particular to a pick-and-place device for the socket connector.

2. The Related Arts

A socket connector for mounting a Central Processing Unit (CPU) module to a circuit board comprises a rectangular base housing having a rectangular central opening and defining a number of cells arranged around the central opening. Conductive contact elements are received in the cells and have tails extending beyond the base housing for being soldered to the circuit board. A cover is movably supported on a top surface of the base housing and carries the CPU module thereon. The cover has a central opening substantially corresponding to the central opening of the base housing and a number of passages in registration with the cells. Pin legs depending from the CPU module are received in the passages and partially extend into the cells for physical engagement with the contact elements.

To properly position the socket connector on the circuit board, a pick-and-place device is employed to handle the socket connector. The pick-and-place device is attached to the socket connector in a releasable manner and has a flat surface for cooperating with a vacuum suction device. To accommodate the vacuum suction device, the flat surface must have a large area. An example is shown in a co-pending US patent application filed on Dec. 7, 2001, Ser. No. 10/031,381 which is assigned to the same assignee of the current application. The conventional pick-and-place device is conveniently made of synthetic materials that are insulation to heat. The conventional pick-and-place device comprises a board having a surface area covering all or most of the passages when the pick-and-place device is attached to the socket connector. The board must have a thickness sufficient to support the vacuum suction.

In carrying out soldering operations to attach the tails of the contact elements to the circuit board, a great amount of heat must be applied to and/or dissipated from the socket connector. Covering all or most of the passages by the conventional pick-and-place device is in general disadvantageous to heat transfer during the soldering operation.

SUMMARY OF THE INVENTION

Accordingly, an object of the present invention is to provide a pick-and-place device for a socket connector that allows excellent heat transfer in soldering operations.

Another object of the present invention is to provide a pick-and-place device allowing excellent heat transfer in soldering operations, while protecting the socket connector from contaminant occurring in the soldering operations.

To achieve the above objects, in accordance with the present invention, a pick-and-place device comprises a substantially rigid board having a bottom face positionable and releasably attachable to a surface of a socket connector in which a plurality of passages are defined. The rigid board covers a first group of the passages with a second group of the passages not covered by the board. Openings are defined in the board to expose some of the passages of the first group for enhancing heat transfer. A solid portion of the rigid board forms a top face of the board for vacuum handling purposes. A flexible, thin film has a first surface on which adhesive is coated for attaching the film to socket connector and covering both the passages of the second group and the exposed passages of the first group for shielding the passages against contaminants. The film partially overlaps and is adhesively attached to the top face of the board and has an opposite second surface exposed for vacuum handling of the socket connector. The film is thin and thus has no significantly adverse effect on heat transfer.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
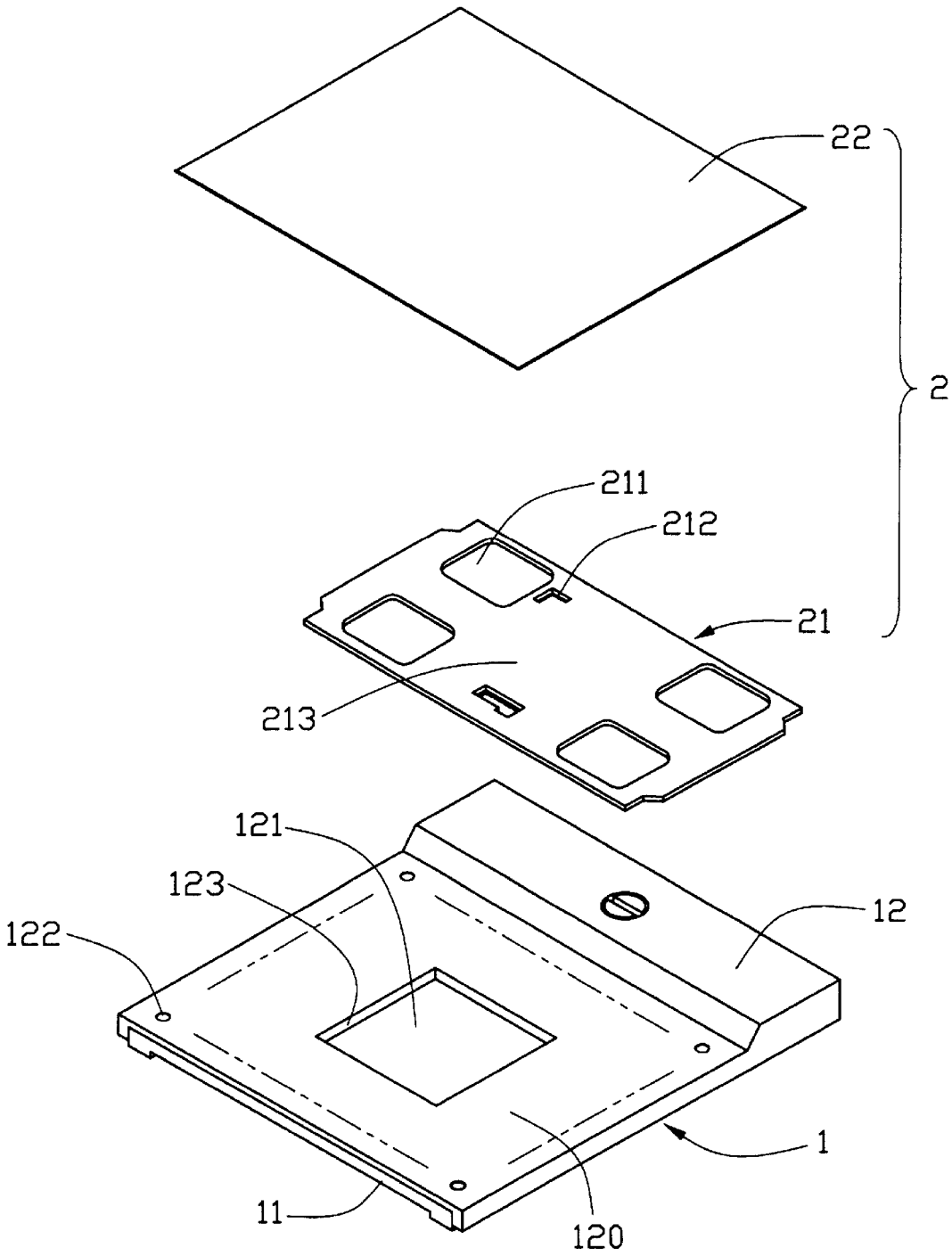
FIG. 1 is a perspective view showing a pick-and-place device in accordance with the present invention to be mounted to a socket connector.

With reference to the drawings and particularly to FIG. 1, a pick-and-place device constructed in accordance with the present invention, generally designated with reference numeral 2, is adapted to be mounted to a socket connector 1 for vacuum handling and protection purposes. The socket connector 1 comprises a base housing 11 positionable on a circuit board (not shown) and retaining contact elements (not shown) to be soldered to the circuit board. The socket connector 1 also comprises a cover 12 movably supported on the base housing 11. The cover 12 defines a central opening 121 having a side wall 123. The cover 12 has a surface 120 in which a number of passages 122 are defined and arranged around the central opening 121 for the extension of pin legs depending from an electronic device (both not shown).

To properly handle the socket connector 1 during a soldering process that connects the contact elements of the socket connector to the circuit board, the pick-and-place device 2 of the present invention is releasably attached to the socket connector 1 to facilitate handling the socket connector 1 with a vacuum suction device (not shown). The pick-and-place device 2 comprises a board 21 having a thickness sufficient to support the vacuum suction. Thus, the board 21 is substantially rigid. The board 21 has a bottom face (not labeled) positioned on the cover 12 and covering a first portion (not labeled) of the surface 120 of the cover 12. A second portion (not labeled) of the surface 120 of the cover 12 is exposed. Ribs 212 are formed on the bottom face of the board 21 to retainingly engage the side wall 123 of the central opening 121 of the cover 12 thereby attaching the board 21 to the socket connector 1.

When the board 21 is attached to the cover 12 of the socket connector 1, a first group of the passages 122 that is located in the first portion of surface 120 of the cover 12 is covered by the board 21, while a second group of passages 122 that is located in the second portion of the surface 120 of the cover 12 is exposed. The board 21 defines a number of openings 211 to expose some of the passages 122 of the first group located in the first portion of the surface 120 of the cover 12. A solid portion of the board 21 is formed between the openings 211 and has a top face 213 to which the vacuum suction device is attached. The exposure of some of the passages 122 of the first group by the provision of the openings 211 of the board 21 allows good heat transfer in the soldering process. However, such openings 211 suffer a risk of contaminating the passages 122 and contact elements of the socket connector (not shown) by debris or other contaminants generated during the soldering process. Such debris or contaminants may get into the passages 122, causing undesired blockage or other problems of the passages 122 and damage and contamination to the contact elements.

Figure 2:
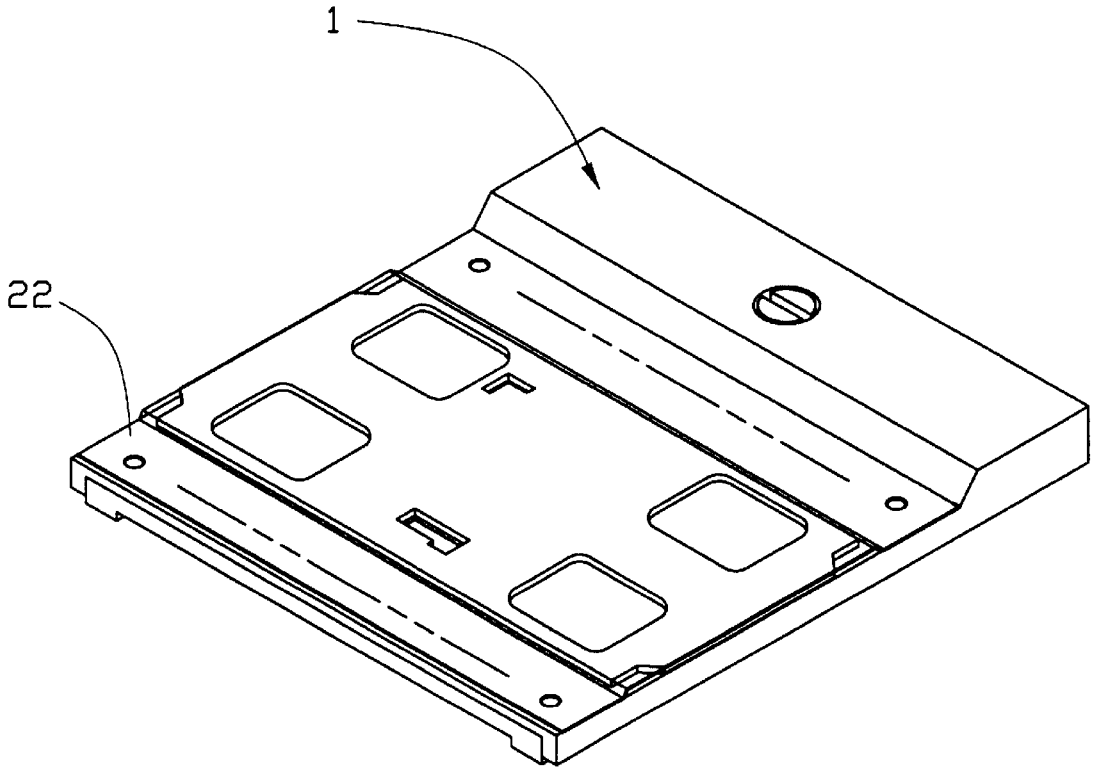
FIG. 2 is a perspective view showing the pick-and-place device of the present invention mounted to the socket connector.

Also referring to FIG. 2, a flexible, thin film 22, such as an PI-film or a paper tape, having a first surface coated with adhesives, is releasably attached to and overlaps both the board 21 and the second portion of the surface of the cover 12 and an opposite second surface exposed for vacuum-handling. The adhesive film 22 has a surface area sufficient to cover all the exposed passages 122 for protection of the passages 122 and the contact elements thereof. Due to the very small thickness of the film 22, no significantly adverse effect against heat transfer is resulted in, allowing the soldering process to be carried out efficiently and effectively. The film 22 can be removed at any time after the socket connector 1 is securely mounted to the circuit board.

The film 22 is preferably made of a material capable to bear the high temperature caused by the soldering process.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A pick-and-place device adapted to be releasably mounted to a socket connector having a surface defining a central opening and a plurality of passages, for vacuum handling of the socket connector, the pick-and-place device comprising:

a substantially rigid board having a bottom face adapted to be positioned on the surface of the socket connector and releasably attached to the socket connector for shielding a portion of the surface of the socket connector and some of the passages;

wherein openings are defined in the board for exposing at least a portion of the shielded passages for heat transfer purposes; and wherein the board has a solid portion aligned with the central opening and having a top face large enough for the vacuum-handling; and a thin film having a first surface having an adhesive coating for releasably attaching the film to the socket connector to shield passages that are not shielded by the board;

wherein the film overlaps the top surface of the board and has an opposite second surface exposed for the vacuum-handling.

2. A pick-and-place device adapted to be releasably mounted to a socket connector having a surface defining passages for vacuum handling of the socket connector, the pick-and-place device comprising:

a substantially rigid and rectangular board releasably attached to the surface of the socket connector to cover a first portion of the surface with a second portion of the surface exposed;

wherein a first group of the passages are located in the first portion of the surface of the socket connector and a second group of the passages are located in the second portion of the surface of the socket connector, and the board defines four corner openings to expose some of the passages of the first group; and a thin film having a first face having a coating of adhesive releasably attached to and covering both the board and the exposed second portion of the surface of the socket connector and an opposite second face exposed for the vacuum handling wherein the film covers the passages of the second group and the exposed passages of the first group.

3. The pick-and-place device as claimed in claim 2, wherein the film is made of a temperature resistant material and is thus adapted to bear a high temperature caused by a soldering process for mounting the socket connector to a circuit board.

* * * * *